United States Patent [19]

Hiller

[11] 4,152,551

[45] May 1, 1979

[54] POCKET HEARING AID WITH SLIDEABLE MECHANISM FOR BATTERY REPLACEMENT AND ACCESS OPENINGS

[75] Inventor: Erhard Hiller, Langnau, Switzerland

[73] Assignee: Minisonic AG, Zug, Switzerland

[21] Appl. No.: 915,959

[22] Filed: Jun. 15, 1978

[30] Foreign Application Priority Data

Jun. 27, 1977 [AT] Austria ..... 4540/77

[51] Int. Cl.[2] ..... H04R 1/02; H04R 25/04

[52] U.S. Cl. ..... 179/107 R; 179/179

[58] Field of Search ..... 179/107 R, 179

[56] References Cited

U.S. PATENT DOCUMENTS 2,789,160 4/1957 Gage ..... 179/107 R

*Primary Examiner*—George G. Stellar

*Attorney, Agent, or Firm*—Werner W. Kleeman

[57] ABSTRACT

An essentially parallelepiped-shaped housing has a slide at which there is formed a drawer-like constructed compartment for the reception of a current source. In the closed position of the slide such coincides with one of the base surfaces of the housing. During the course of an opening movement the slide initially frees the compartment, and thereafter, during a further opening movement, frees access openings for adjustment or tuning elements or the like located at the side of the housing body dispositioned opposite the compartment. Operatively associated with the first opening step for freeing the compartment are stops over which there can travel the slide. Equally, stops are operatively associated with the slide for the further opening step for freeing the access openings.

10 Claims, 10 Drawing Figures

POCKET HEARING AID WITH SLIDEABLE MECHANISM FOR BATTERY REPLACEMENT AND ACCESS OPENINGS

BACKGROUND OF THE INVENTION

The present invention relates to a new and improved construction of a pocket hearing aid or device having an essentially parallelepiped-shaped housing which has access openings for adjustment or tuning elements for the electrical part of the device and which access openings can be closed by a slide as well as a compartment for the reception of a current source, the compartment being movable from an open into a closed position, and the outer wall of the compartment coincides with one of the side surfaces of the housing.

In the context of this disclosure there is to be understood under the term source a single cell of an electrical element, for instance a galvanic element or cells which has been interconnected into a battery.

A state-of-the-art pocket hearing aid of the previously mentioned type comprises an essentially parallelepiped-shaped housing, whose one lengthwise extending side coincides with the slide or slide member and the other lengthwise extending side coincides with the outer wall of the compartment which can be rocked out about a hinge or a pivot pin. The slide covering the access openings leading to the adjustment or balancing elements or the like, extends in the lengthwise direction of the housing and can be opened transversely with respect to its lengthwise extent by engaging the same with the nail of a finger. Since the slide therefore is displaceably arranged in the direction of its wide side, both during opening and closing thereof it tends to easily cant.

In order to open the outwardly pivotable compartment it is necessary to engage with the nail of a finger into a recessed gripping edge, while the housing must be held with the other hand. Since such type devices are especially used by older individuals, these manipulations performed during exchange of the current source can be quite cumbersome and problematic for such individuals. As a result, it has been found that the exchange of the current source, under circumstances, can be put off for an indefinite amount of time, and the relatively expensive device is no longer capable of fulfilling its intended service. This, in turn, can lead to a negative commercial evaluation of such devices.

During improper handling of the outwardly pivotable compartment, it is possible with this prior art device to expose to shear loads, owing to the lever action, its support or bearing elements. However, in order to avoid damage of the support or bearing elements there is required a robust construction. Yet, in consideration of the extremely small available space this, in turn, practically only can be satisfactorily accomplished by the use of metallic bearing pins. However, since the housings of such devices are preferably fabricated from plastic material, the use of an arrangement employing metallic bearing pins requires an increased expenditure in the fabrication, and thus, increased costs.

The slide and the outwardly pivotable compartment of the heretofore known device posses a number of non-overlapping joints in relation to the housing body, through which there can easily penetrate into the housing interior contaminants or other undesirable foreign objects.

SUMMARY OF THE INVENTION

Hence, with the foregoing in mind it is a primary object of the present invention to provide an improved construction of pocket hearing aid which is not associated with the aforementioned drawbacks and limitations of the prior art proposals.

Another and more specific object of the present invention aims at the provision of a new and improved construction of a pocket hearing aid wherein the current source can be exchanged with the least complications, so that even elderly and, furthermore, technically unskilled individuals, can easily exchange the current source.

A still further object of the present invention aims at a new and improved construction of pocket hearing aid wherein the slide or slide member can shift in a faultless manner and free from any danger of canting or tilting.

Yet a further significant object of the present invention aims at the provision of a new and improved construction of pocket hearing aid which is relatively simple in design, economical to manufacture, extremely reliable in operation, easy to use, and allows certain necessary operations to be performed by the user or other unskilled individuals with the minimum of effort.

A further significant object of the present invention aims at the provision of a new and improved construction of pocket hearing aid which is not associated with the aforementioned drawbacks and limitations of the prior art constructions heretofore discussed.

Now in order to implement these and still further objects of the invention, which will become more readily apparent as the description proceeds, the pocket hearing aid or device of the present development is manifested by the features that the drawer-like constructed compartment is formed at the slide or slide member itself and the slide, in its closed position, coincides with one of the base surfaces of the housing. Further, the slide during the course of its opening movement which is accomplished transversely with respect to the aforementioned side surface initially frees the compartment, and thereafter, during a further opening movement, the access openings.

By virtue of this solution the slide and the compartment are united into a single component, so that the housing inclusive of the slide only consists of two parts, namely the housing body and the slide. Mounting of such slide in the housing body is associated with appreciably less problems than those encountered when providing an outwardly pivotable compartment. The user of the device can more easily remember or ascertain the linear direction of movement of the slide for opening the compartment or chamber during the exchange of the current source than a direction of opening of an outwardly pivotable compartment or chamber, especially when the position of the pivot axis is not readily ascertainable or recognizable when the compartment is closed.

Due to the drawer-like construction of the compartment, after opening such compartment, the current source is freely exposed and accessible for exchange purposes. This constitutes an appreciable advantage during handling of the device, since the current source, during the exchange thereof, must be capable of being retrieved out of the housing more or less without any cumbersome movements or difficulties, as such generally is the case for battery-operated devices.

According to a preferred exemplary embodiment first stops or impact members can be arranged at the housing body and at the slide, which coact with one another when the compartment is open and only upon traveling thereover do they free the access openings. Due to such arrangement the slide can only be pulled-out to such an extent until the compartment is completely open for exchanging the current source. The access openings, in this position of the slide, remain further closed, since the adjustment elements or the like located therebehind are only provided for tuning or the like by trained individuals.

According to a further exemplary embodiment of the invention second stops or impact members for limiting the further opening movement of the slide, with the access openings freed or opened, can be arranged at the housing body and at the slide. The second stops, following the further opening movement, prevent that the slide can drop out of the housing body. The trained technician or the like therefore has the possibility of rapidly closing the slide following the adjustment work at the adjustment or tuning elements, so that the current source, after the adjustment operation, can be briefly again connected in circuit for checking-out the device.

According to a further construction of the invention there can be arranged at the housing body and at the slide latching elements for latching the slide in its closed position, in order to secure the slide against unintentional opening.

Further, the compartment can be bounded by a rear wall, which, with the compartment open, covers the opening which has been freed in the housing, in order to prevent that the circuit elements arranged in the housing will be contacted during exchange of the current source, or, even damaged. The slide in its closed position can be arrested or in addition to the previously explained measures or, even alone, can be arrested in position by a protective hood which can be mounted at one end face or side of the housing and engaging over a part of the slide. Such protective hood can cover the normally freely accessible adjustment elements, such as for instance the volume or loudness adjuster and protect such against any undesired detuning or misadjustments.

According to a further preferred embodiment of the invention the first stops, related to the direction of movement of the slide, can be arranged at the center and can be brought by pressure applied at the housing body out of engagement. Due to such arrangement the first stops can be easily traveled over whenever it is necessary to have the trained technician adjust the adjustment or balancing elements or the like which are accessible by means of the access openings.

Related to the direction of movement of the slide, the second stops can be arranged to both sides of the slide. This bilateral arrangement insures that the slide which has been pulled out quite far in this position will not cant.

Quite generally, the housing of the inventive pocket hearing aid not only possesses fewer individual parts, rather there is particularly simplified also the assembly of such device or hearing aid particularly due to the elimination of any pivotal support or bearing means. As a peripheral remark it might be noted that the housing of the inventive device also has a more aesthetic appearance and construction due to the elimination of joints which extend through from its outer surfaces, since the slide, on the one hand, can occupy the entire base surface and the thereat formed compartment, on the other hand, can occupy the entire side surfaces of the housing, so that the closed housing only has joints neighboring its edges. The large surface construction of the slide facilitates the opening operation during exchange of the current source, something which is particularly of advantage when the unit is used by invalid and older individuals.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 10 illustrates a front view of the housing with further pulled-out slide for freeing the access openings to the adjustment or balancing elements or the like.

DETAILED DESCRIPTION OF THE PREFERRED EMBODIMENTS

Figure 1:
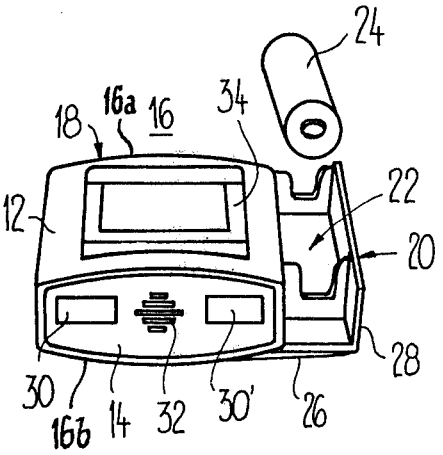
FIG. 1 is a perspective view of a pocket hearing aid constructed according to the teachings of the present invention and showing the compartment open.

Describing now the drawings, in FIG. 1 there is illustrated an exemplary embodiment of pocket hearing aid or device in perspective view showing its upwardly directed rear side or face 12 and its top surface or side confronting the viewer. The housing 16 of this device comprises a housing body 18 and a drawer-like slide or slide member 20 which is shown in a retracted position. Formed at the slide 20 is a compartment or chamber 22 for receiving a suitable current source 24, here in the form of a single cell. The housing 16 is essentially of parallelepiped-shaped configuration, however has domed base surfaces, generally indicated by reference characters 16*a* and 16*b*, wherein the one base surface 16*a* forms the rear side 12 of the housing 16. The other oppositely situated base surface 16*b*, when the housing 16 is closed, constitutes an outer surface of the slide or slide member 20, which, forms the front side 26 of the housing 16 which is not particularly further shown in FIG. 1. The slide 20 is essentially formed by the front side 26 and the lengthwise extending or longitudinal side 28 which is disposed at right angles or perpendicular thereto. Hence, both of the sides 26 and 28 form outer surfaces of the housing 16. The upper or top side 14 of the housing 16 has two openings 30 and 30' for the reception of not particularly illustrated switches or adjustment elements and slots 32 for a microphone located behind such slots 32 and therefore not visible in the showing of the drawing of FIG. 1. At the rear side 12 there is arranged a clip 34 by means of which the deive can be clamped to the edge of a pocket or otherwise appropriately carried or supported by the user.

Figure 2:
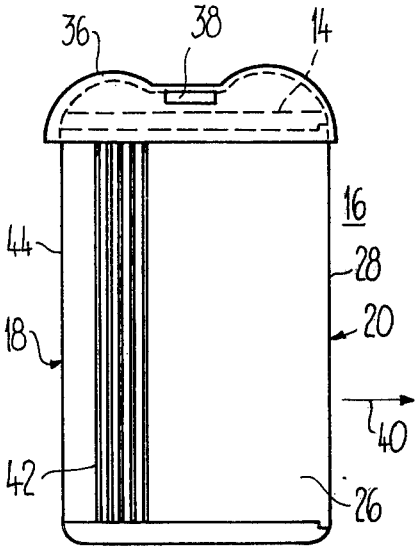
FIG. 2 is a front side view of the pocket hearing aid of FIG. 1 equipped with a protective hood or covering.

Now in FIG. 2 the housing 16 has been illustrated in an elevational view as seen from its front side 26. In this illustration the slide 20 has been pushed-in and the housing 16 therefore is closed. Seated upon the top or upper side 14 of the housing 16 is a protective hood or covering 36 which engages about the housing body 18 and the slide 20, and therefore, prevents any unintentional opening of the slide 20. The protective hood 36 advantageously, although not of necessity, is formed of a transparent plastic and therefore additionally serves to prevent any unintentional readjustment or actuation of the not particularly illustrated switch and the not illustrated adjustment elements. However, so that the microphone which is assembled in the pocket hearing aid or device is able to absorb the sound energy from the surroundings, the protective hood 36 has in the direction of the front side and in the direction of the rear side a respective opening 38. Also, this protective hood 36 essentially prevents the penetration of contaminants or other foreign objects into the interior of the housing 16 through the joints formed between the switch and the adjustment elements and the openings 30 and 30' (FIG. 1).

In order to be able to effortlessly open the slide 20 in the direction of the arrow 40 such is provided at the front side 26 with a number of gripping grooves or knurled portions 42. The gripping grooves 42 extend transversely with respect to the displacement direction 40 of the slide 20 and are arranged neighboring the end of the slide 20 which trails in such direction of displacement 40. Since the front side 26 is outwardly domed, as best seen by referring to FIG. 1, the gripping grooves 42 or equivalent structure, as seen with regard to the displacement direction 40, are located at the ascending part of the domed portion. This arrangement is particularly favorable from the standpoint of gripping the device, since the slide 20 can be effortlessly opened by placing the fingers of the user flatly against the gripping grooves 42 or by flatly placing the thumb. Particularly suitable as the counter-support of the housing body 18 during opening of the slide 20 is the clip 34 arranged at the rear side 12. In order to exchange the current source 24 the housing 16 therefore can be opened with one hand. To close the housing 16 it is only necessary to shove towards one another both of the longitudinal or lengthwise extending sides 28 and 44 of the slide 20 and the housing body 18, respectively.

Figure 3:
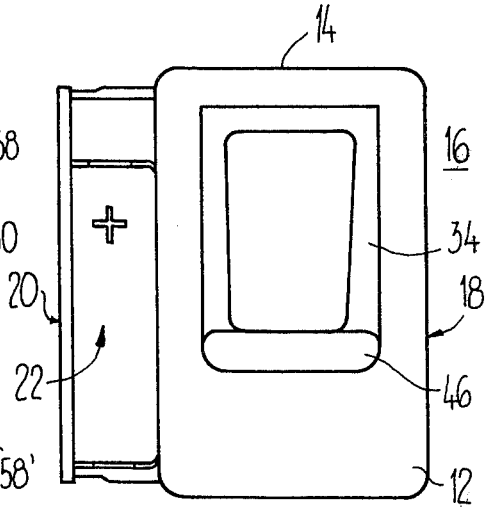
FIG. 3 illustrates a rear view of the pocket hearing aid or device of FIG. 1 with the compartment open.

Now in FIG. 3 the housing 16 is illustrated at its rear side or face 12 confronting the observer. The slide 20 is pulled-out for exchanging the current source which has not here been particularly shown in this Figure, in the same manner as illustrated in FIG. 1. The clip 34 is covered at its free end with a plastic part or portion 46 constructed to be free of edges in order to prevent any damage to the clothing during use of the device.

Figure 4:
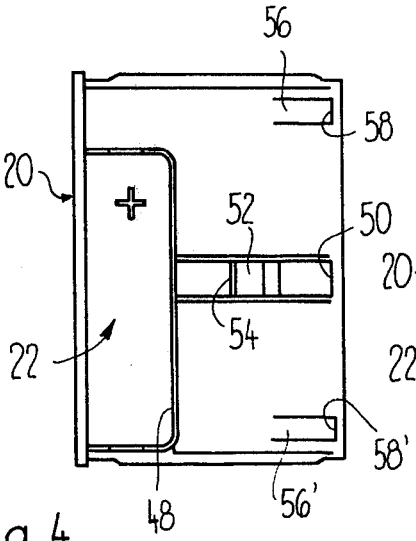
FIG. 4 illustrates details of the slide containing the drawer-like compartment or chamber.

FIG. 4 shows the slide 20, when completely pulled out of the housing body or part 18, as seen from its side confronting the interior of such housing. The compartment or chamber 22 is delimited by a rear wall 48, which, with the slide 20 pulled-out for exchanging the current source, closes the opening which has been freed in the housing 16 in the position illustrated in FIGS. 1 and 3, in order to prevent access to the circuit elements arranged within the housing 16.

In order that the slide 20 only can be pulled-out up to the position illustrated in FIGS. 1 and 3 for the purpose of exchanging the current source, such as the single cell or battery 24, it will be seen that such slide 20 is advantageously equipped with a first stop or impact member 50 which coacts with a first stop or impact member 66 arranged at the housing body 18. In order to latch the slide 20 in its closed position the same is provided with a latching or locking nose 52 at its intermediate region and having a latching surface 54 which coacts with a latching surface arranged at the housing body 18 as will be explained more fully hereinafter. Arranged neighboring the corner points of the slide 20 at its inner surface are substantially wedge-shaped recesses or depressions 56 and 56' having stop or impact surfaces 58 and 58', respectively, which will be described more fully hereinafter in conjunction with the following Figures and serve as second stop or impact means for limiting the retraction of the slide in a further position.

Figure 5:
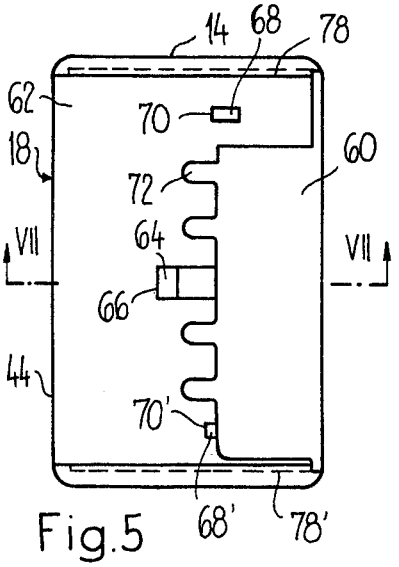
FIG. 5 illustrates the housing body of the device as seen from the front side with the slide removed.

FIG. 5 illustrates the housing body 18 in the same position as has been shown in FIG. 2 previously discussed, however with the slide 20 completely retracted out of the interior of the housing 16. An open space 60 in the housing interior serves for the reception of the compartment 22 which is formed at the slide or slide member 20. At the left longitudinal side 44 and bounding the top side 14 the housing body 18 is provided with a separation or partition wall 62, which, is covered by the slide 20 when the same is closed. At the intermediate region of this partition wall 62 there is arranged a latching or locking nose 64 having a first stop or impact member 66, which, with the slide 20 closed, engages behind the latching surface 54 arranged at the inside of the slide 20, so that the slide 20 can be latched in its closed position. The latching surface 54 is positioned at an inclination in the displacement direction 40, in order to oppose the opening movement only with a limited holding force and to render possible, through the exertion of very little force, travel over such latching element. During opening of the slide 20 for exchanging the current source 24 the first stop 50 arranged at the slide 20 engages behind the first stop 66 arranged at the housing body 18. Due to the coaction of these first stops 50 and 66 there is limited the pulling-out of the slide 20 to the position illustrated in FIGS. 1 and 3 as well as also in FIG. 9. In this position there is readily accessible the current source 24 which is to be removed out of the compartment or chamber 22, since it is freely exposed in the drawer-like compartment 22, in order to thus either be removed or by turning over the housing 16 ejected from such compartment 22.

Furthermore, arranged upon the partition wall 62 at oppositely situated sides are two latching noses 68 and 68' having stop or impact surfaces 70 and 70'. These stop surfaces 70 and 70' are intended to coact as second stops with the stop or impact surfaces 58 and 58' arranged at the inside of the slide 20. These second stops then become effective when the coacting first stops 50 and 66 are traveled over during further opening of the slide 20. In order to travel over the first stops 50 and 66 the partition wall 62 must be inwardly pressed with a finger or the thumb at the region of its latching nose 64, whereas the slide 20 is pulled-out until reaching the second stops 70, 58 and 70', 58'. In this position of the slide 20, which has been illustrated in FIG. 10, the access openings 72 arranged at the partition wall 62, which are here formed by cut-outs are exposed or laid-open. Behind the access openings 72 there are arranged in the housing 16 the standard adjustment or balancing elements or the like which therefore have not been particularly shown. These adjustment or balancing elements can be for instance adjustable resistors, by means of which it is possible to tune the characteristic of the device to the requirements of the relevant user.

Figure 9:
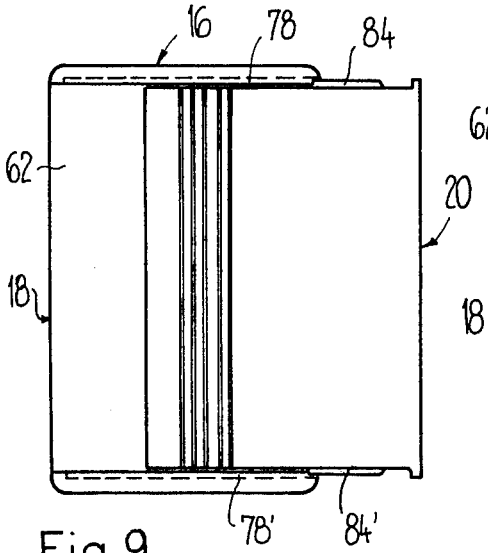
FIG. 9 illustrates the housing in front view with the slide pulled out according to FIG. 3.

While FIG. 2 shows the housing 16 in its closed position, the illustrations of FIGS. 1, 3 and 9 show the position of the slide 20 for exchanging the current source 24. Without any further actuation the slide 20 only can be moved back-and-forth between both of these mentioned positions, so that the user of the device, during exchange of the current source, does not come into contact with the circuit elements arranged in the housing 16 without any further manipulations. Due to such arrangement there can be extensively avoided any mechanical damage to the circuit elements arranged in the housing 16 owing to unauthorized access.

Figure 10:
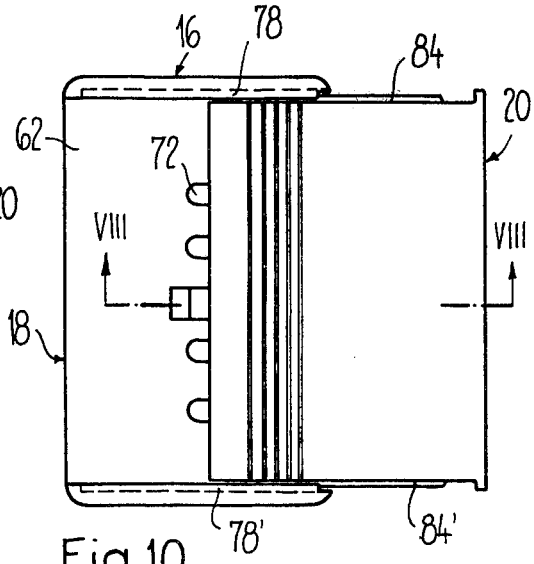

On the other hand, for the skilled technician who is trained to tune or adjust the adjustment elements it is a small matter, by simply exerting pressure at the intermediate or central region of the partition wall 62, to open the slide 20 into the position illustrated in FIG. 10. In this position there is prevented the further opening of the slide 20 due to the engagement of the second stops 70, 58 and 70', 58', so that such is continuously retained in operative connection with the housing body 18.

On the other hand, if the slide 20 should be completely pulled-out, for instance for repairing the device, then there must be exerted at the partition walls 62 at the direct neighborhood of the latching noses 68 and 68' a more intensified inwardly directed pressure, in order to travel over the second stops. However, in order to be able to again push-in the slide 20 without any hinderance, the latching noses 68, 68' and 64 are advantageously constructed to be wedge-shaped.

Figure 6:
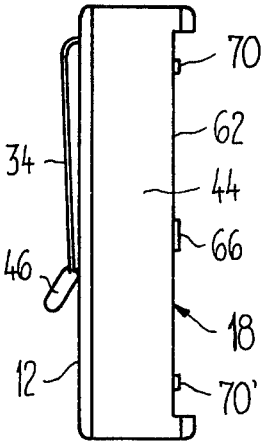
FIG. 6 is a side view of the housing body with the slide removed.

FIG. 6 illustrates the housing body 18 from its left longitudinal side 44. In this position it will be apparent that the stop surfaces 70, 70' and 66 of the latching noses 68, 68' and 64, respectively, protrude in relation to the partition or separation wall 62.

Figure 7:
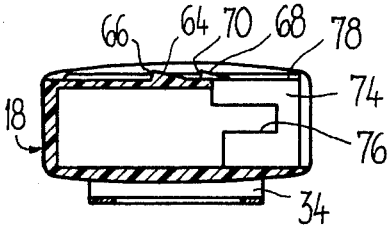
FIG. 7 illustrates a cross-sectional view of the housing body, taken substantially along the line VII—VII of FIG. 5.

FIG. 7 illustrates a section through the housing body 18 corresponding to the line VII—VII of FIG. 5. From this showing of FIG. 7 there will be particularly apparent the wedge-shaped construction of the latching noses 64 and 68. A transverse wall 74 having a cut-out or recess 76 bounds at an end wall of the compartment 22 formed at the slide or slide member 20. At the edge of the housing body 18 and neighboring its top or upper side 14 there will be seen one of the guide grooves 78 for the slide 20.

Figure 8:
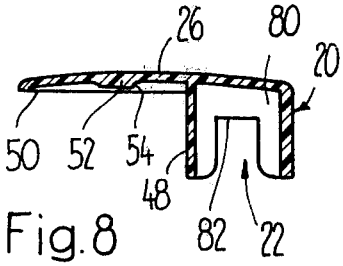
FIG. 8 is a cross-sectional view of the slide with the thereat formed compartment, taken substantially along the line VIII—VIII of FIG. 10.

FIG. 8 illustrates a cross-sectional view through the slide 20 along the section line VIII—VIII of FIG. 10. It will be especially seen from this illustration the wedge-shaped latching nose 52 with inclined positioned latching surface 54 as well as the first stop 50. Further, it will be additionally seen that the rear wall 48 of the chamber of compartment 22 approximately corresponds to the depth of the internal dimensions of the housing 16. An end side-limiting wall 80 of the compartment 22 has a cut-out or recess 82, in order to render possible the connection of the current source 24 with the connection contacts.

FIGS. 9 and 10 have already essentially been discussed following the discussion of FIG. 5 given heretofore. It will be apparent by referring to both of these FIGS. 9 and 10 that the slide 20 has guide webs 84 and 84' at its two sides, by means of which this slide is guided in the guide grooves 78 and 78', respectively, in the sliding direction.

Furthermore, from the showing of FIGS. 2 and 3 it will be clearly apparent that the front side 26 as well as the rear side 12 of the housing 16 is essentially uninterrupted by any joints. Such configuration imparts to the housing 16 a particularly good rigidity and an aesthetic appearance. The joints present between the housing body 18 and the slide 20 are located at the margins or at the edges of the housing. Since the housing 16 practically only consists of the housing body 18 and the slide 20 it can be fabricated relatively priceworthy. The compartment 22 for the reception of the current source 24 as well as all of the latching elements are formed at both of these aforementioned parts. Due to its large surface the slide or slide member 20 is faultlessly guided in the housing body 18, so that there is practically impossible any canting of the slide during shifting thereof. In order to displace or shift the slide 20 and for releasing the stops there is not required any actuation with finger nails or the like.

While there are shown and described present preferred embodiments of the invention, it is to be distinctly understood that the invention is not limited thereto, but may be otherwise variously embodied and practiced within the scope of the following claims.

Accordingly, what I claim is:

1. A pocket hearing aid comprising:

a housing;

a slide slidably mounted in said housing;

said housing having a compartment for receiving a current source and being movable between an open position and a closed position;

said housing being provided with access opening means by means of which there are accessible adjustment elements of an electrical means of the pocket hearing device;

said access opening means being capable of being covered by said slide;

said slide being substantially of drawer-like construction and containing said compartment;

said housing having side surfaces;

said compartment having an outer wall constituting a side surface of the housing;

said slide, when in its closed position, constituting at least part of a base surface of the housing;

said slide being movable transversely with respect to said side surface;

said slide during the course of its opening movement initially freeing said compartment and thereafter when assuming a further opening movement freeing the access opening means.

2. A pocket hearing aid comprising:

a housing;

a slide;

means for slidably mounting said slide in said housing;

said housing having a compartment for receiving a current source and being movable between an open position and a closed position;

said housing being provided with access openings by means of which there are accessible adjustment elements of an electrical means of the pocket hearing device;

said access openings being capable of being covered by said slide;

said slide being substantially of drawer-like construction and containing said compartment;

said housing having side surfaces and base surfaces;

said compartment having an outer wall coinciding with one of the side surfaces of the housing;

said slide, when in its closed position, coinciding with one of the base surfaces of the housing;

said slide being movable transversely with respect to said side surfaces;

said slide during the course of its opening movement transversely with respect to said surfaces initially freeing said compartment and thereafter when assuming a further opening movement freeing the access openings.

3. The pocket hearing aid as defined in claim 2, wherein:

said housing includes a housing body;

latching elements arranged at said housing body and at said slide for latching the slide in its closed position.

4. The pocket hearing aid as defined in claim 2, wherein:

said housing has end sides;

said slide being arrestable in its closed position by means of a protective hood mountable at an end side of the housing and engagable about a part of the slide.

5. The pocket hearing aid as defined in claim 2, wherein:

said housing includes a housing body;

second stop means provided at the housing body and at said slide for limiting the further opening movement of the slide with the access openings opened.

6. The pocket hearing aid as defined in claim 5, wherein:

said second stop means, related to the direction of movement of the slide, are arranged to both sides thereof.

7. The pocket hearing aid as defined in claim 2, wherein:

said housing includes a housing body;

first stop means arranged at said housing body and at said slide;

said first stop means at said housing body and at said slide coacting with one another when the compartment is open and first freeing the access openings after said first stop means mutually travel over one another.

8. The pocket hearing aid as defined in claim 7, wherein:

said first stop means, related to the direction of movement of the slide, are arranged at an intermediate portion of said slide and said housing and by exerting pressure at the housing body can be brought out of engagement.

9. The pocket hearing aid as defined in claim 7, wherein:

said compartment being delimited by a rear wall which covers an opening which has been freed in the housing when the compartment is opened.

10. The pocket hearing aid as defined in claim 7, further including:

second stop means arranged at said housing body and at said slide for limiting the further opening movement of the slide with the access openings opened.

* * * * *